United States Patent [19]

Santagiuliana

[11] Patent Number: 4,995,520

[45] Date of Patent: Feb. 26, 1991

[54] SAFETY CAP

[75] Inventor: Evans Santagiuliana, Vicenza, Italy

[73] Assignee: Taplast SNC di Evans Santagiuliana & C., Vicenza, Italy

[21] Appl. No.: 292,535

[22] Filed: Dec. 30, 1988

[30] Foreign Application Priority Data

Jan. 11, 1988 [IT] Italy ..... 85501 A/88

[51] Int. Cl.[5] ..... B65D 55/02

[52] U.S. Cl. ..... 215/220; 215/253

[58] Field of Search ..... 215/217, 218, 219, 220, 215/250, 253

[56] References Cited

U.S. PATENT DOCUMENTS

| | | | |
|---|---|---|---|
| 3,853,236 | 12/1974 | Ostrowsky | 215/220 |
| 4,285,437 | 8/1981 | Morris | 215/220 |
| 4,330,067 | 5/1982 | Deussen | 215/220 |
| 4,555,036 | 11/1985 | Bekkers et al. | 215/220 |
| 4,624,377 | 11/1986 | Wassilieff | 215/220 |
| 4,632,264 | 12/1986 | Evans | 215/220 |
| 4,635,806 | 1/1987 | Williamson | 215/220 |
| 4,729,487 | 3/1988 | Wright | 215/220 |
| 4,801,028 | 1/1989 | Puresevic et al. | 215/220 |
| 4,832,218 | 5/1989 | Gibilisco | 215/220 |

FOREIGN PATENT DOCUMENTS

| | | |
|---|---|---|
| 0184795 | 6/1986 | European Pat. Off. . |
| 2465654 | 3/1981 | France . |
| 1181798 | 9/1987 | Italy . |

*Primary Examiner*—Stephen Marcus
*Assistant Examiner*—Nova Stucker

[57] ABSTRACT

A safety cap (1) particularly suited for closing containers having an essentially cylindrical shape and containing medicines or dangerous substances consists of an inner element (10) which is tightened on the container (40), an outer element (30) placed over the inner part (10) and a central push button (20) positioned between the inner element (10) and the outer element (30). When the cap is turned in the tightening direction, the cap is closed; on the other hand, in order for the container to be opened, the cap must be turned in the opposite direction while the central push button (20) is simultaneously pressed. The central push button (20) acts as a transmission element between the outer element (30) and the inner element (10). The central push button (20) can be reached through a hole (37) at the center of the flat top surface (38) of the outside element (30). The hole (37) includes a safety seal consisting of a disc (60) connected with the outside element (30) by extensions (61) which will break under pressure. The cap (1) has limited overall radial dimensions and safety properties against unwanted openings, especially by children or handicapped people.

10 Claims, 2 Drawing Sheets

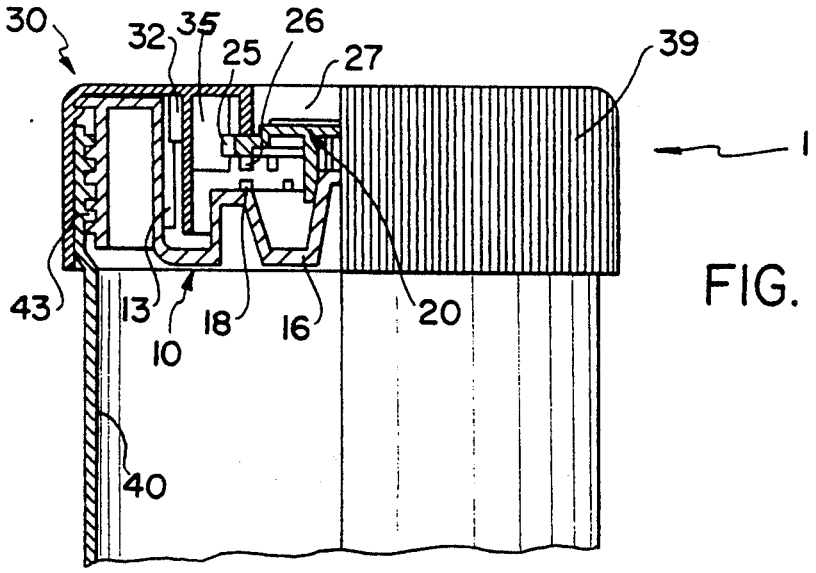
FIG. 1
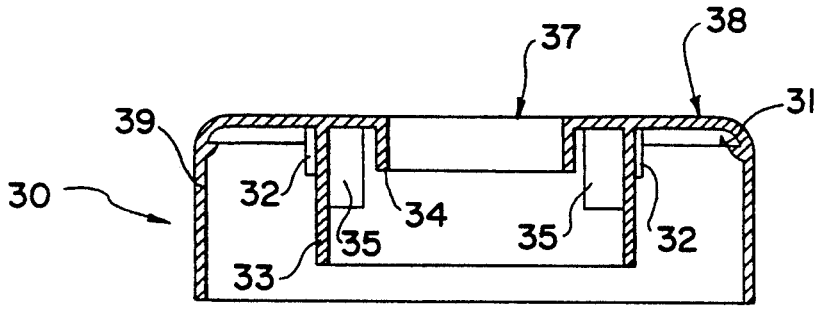
FIG. 2
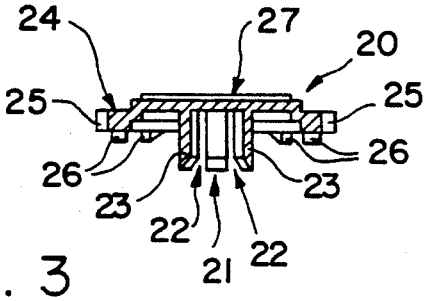
FIG. 3
FIG. 4
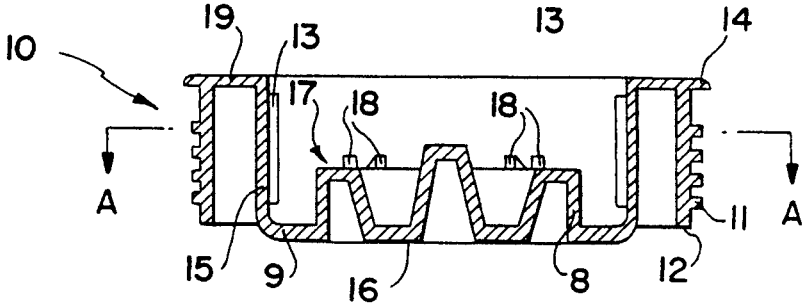

SAFETY CAP

BACKGROUND OF THE INVENTION

The invention concerns the construction of a safety cap, particularly suited for bottles, vials, jars and, in general, for containers having an essentially cylindrical shape and containing medicines or other potentially dangerous substances.

DESCRIPTION OF THE BACKGROUND ART

One of the precautions adopted by those who put on the market potentially dangerous substances, is that of supplying the containers holding such substances with caps, which somehow guarantee a gradual outpour or the outpour of a certain quantity, which would cause no dammage, of the substances contained therein.

Another precaution adopted especially for containers or bottles holding, for instance, poisons, corrosive liquids or medicines in general, is that of seeing to it that these containers may not be opened easily. In this respect, a recent law concerning pharmaceutical products, which is meant to protect, above all, children, makes it mandatory for manufacturing companies to enclose medicines in containers having so-called child-proof caps, that is caps which can only be opened, even after the seal has been removed, with a certain set of co-ordinated motions of the fingers.

Some caps of this type, mostly made of plastic material, are known. They consist of two parts, an inner one, which is tightened around the neck of the container, and an outer one, placed over the inner one and coaxial therewith.

The inner part and the outer part present on their cylindrical surfaces facing each other two cog wheels having cogs slanted so, that they only engage each other in the tightening direction of the cap, while they slide on each other in the untightening direction.

In order to achieve the opening of the cap, it is necessary to axially press the outer part and to turn it at the same time. The untightening occurs because of the action of yet another set of cogs being present on the top surfaces facing each other of the inner and outer parts forming the cap.

A drawback presented by this solution consists in the limited safety offered by the cap against the incautious opening by children, which can be achieved anyway by children of a certain age.

In fact, although the opening requires the pressure of the cap against the container and its simultaneous turning, it is also true that a movement of this nature does not require excessive skill.

In the name of the same inventor was granted an Italian Pat. No. 1181798, concerning a safety cap which eliminates the lamented drawback. In order to obtain the opening of the cap, it is in fact necessary to turn it in the untightening direction and, at the same time, to press a push button being present in its central part, said operations being more difficult to perform at the same time and in a coordinated sequence.

Even the caps of this type present, however, a drawback because of their overall dimensions. In fact, in these caps the inner part is provided with a female thread which tightens around the top of the container to be shut, which in turn is provided with a male thread, so that the external diameter of the cap is considerably larger than the diameter of the upper part of the container around which it is tightened. Moreover, should the container present a constant cross-section, the largest radial overall dimensions of the shut container are given by the external diameter of the cap, which, particularly in the case of containers having an essentially cylindrical shape and a large diameter, entails a considerable loss of usable space when packed.

SUMMARY OF THE INVENTION

The present invention is meant to overcome even this last drawback. The above-mentioned purposes and others, which will be better illustrated hereafter, are fulfilled with the construction of a safety cap, particularly suited for pharmaceutical vials, including an inner element, an outer element placed over the inner element and a central push button positioned between the two elements and lodged within a central hole in the flat surface of the outer element, characterized in that the inner element and the outer element of the cap are rigidly connected with each other in the tightening direction, suitable means being provided to achieve the mutual rigid connection in said direction, further characterized in that the axial pressure of a central push button positioned between the two elements makes them rigidly bound together also in the untightening direction, suitable means being provided on the central push button and on the inner and outer elements of the cap, capable of causing the mutual rigid connection.

The cap presents a thread obtained on the lateral surface of its inner element by means of which it is tightened on the container to be shut, the upper end of which, in turn, has a thread.

Thus, the advantage of a reduced overall radial dimension and, particularly for containers having an essentially constant cross-section, a recovery of usable volume in packaging are obtained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other constructive and functional details will be better understood from the description of a preferred form of execution of the invention, which is given by means of illustration only, but which is not meant to limit its scope, such as it is represented in the enclosed drawing, where:

FIG. 1 is a vertical cross-section of the cap applied to the respective container;

FIG. 2 is a vertical cross-section of the outer element of the cap of FIG. 1;

FIG. 3 is a vertical cross-section of the central push button of the cap of FIG. 1;

FIG. 4 is a vertical cross-section of the inner element of the cap of FIG. 1;

DETAILED DESCRIPTION OF THE PREFERRED EMBODIMENT

Figure 5:
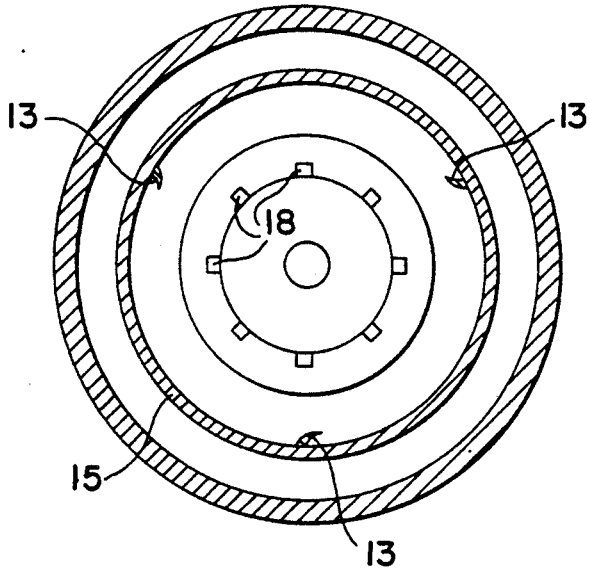
FIG. 5 is a cross-section along the A—A line of the inner part of the cap represented in FIG. 4.

With reference to FIG. 1, the cap according to the invention, indicated as a whole with 1, consists of three elements, and more precisely, of an inner element 10, an outer element 30, and a central push button 20 disposed between the two. The inner element 10 of cap 1 is also represented in FIG. 4 and it consists of two elements or rings 12 and 15, which are concentric to each other and connected together through the flat annular surface 19.

Ring 15 is also closed by a bottom 9. The outer ring 12 has a thread 11 on its outer lateral surface which tightens on thread 43 on the top of the container 40 when shut.

The same inner element 10 also has an edge on the flat annular surface 19 which matches the indentation 31 which is present on the inner top of the bowl 39 constituting the outer element 30 of the cap itself. By matching together the outer element 30 and the inner one 10 and by applying a slight axial pressure, edge 14 is pressed into the indentation 31, thereby insuring the connection between the two elements. The ensuing connection is such as to guarantee a stable connection of the two elements without, however, preventing their mutual rotation around the vertical axis they have in common.

When the outer element 30 and the inner element 10. are matched together, the central push button 20 represented in FIG. 3 is inserted between them. As can be observed in FIG. 1, the central push button 20 is arranged coaxially between the outer element 30 and the inner element 10 of cap 1 and it is kept in position by the frustum-shaped central protrusion 16, which is part of bottom 9 of the inner element 10 and which penetrates into the cylindrical central seat 21 of push button 20.

It will also be observed that the cylindrical central seat 21 has a series of lengthwise slits, such that, when the cylindrical central seat 21 is pressed on the frustum-shaped central indentation 16, the extensions 23 tend to push outwards, thereby exerting an elastic upwards force on the central push button 20. After the cap 1 has been assembled, it presents itself as illustrated in FIG. 1, wherein the inner element 10 is coupled with the outer element 30 and the central push button 20 is positioned between the two with its cylindrical central seat 21 pressed on the frustum-shaped central indentation 16. The central push button 20 with its annular outer surface 24 is latched in an undercut against the central outer ring 34 of the outer element 30.

In FIG. 3 it can also be observed that the central push button 20 presents a series of notches 25 arranged in the peripheral radial circumferential direction and a series of teeth 26 arranged frontally and facing the flat annular surface 17 of the toroid indentation 8 of the inner element 10 with which it is matched.

The inner element 10, in turn, presents on its flat inner surface 17 a number of teeth 18 counterposed to the teeth 26 of the central push button 20, while the outer element 30 presents, in correspondence with the inside of its annular surface 33, three gills 35 arranged preferably at 120° in relation to each other.

When the cap 1 is assembled, the peripheral teeth 25 of the central push button 20 are engaged with the gills 35 of the outer element 30, while the frontal teeth 26 of the same push button are facing the teeth 18 of the inner element 10. The teeth 25, 26 and 18 are provided with appropriate chamferings which are meant to make their coupling easier.

The assembly of cap 1 is performed by inserting the cylindrical seat 21 of the push button 20 on the frustum-shaped indentation 16 of the inner element 10 and by forcing against the latter the outer element 30, so as to cause the ring-shaped edge 14 of element 10 to enter into the indentations 31 of element 30, thereby insuring their connection, without preventing their mutual rotation. Thus, the central push button 20 and, more particularly, its cylindrical seat 21, are forced against the frustum-shaped protrusion 16, so that the ensuing elastic reaction presses its annular surface 24 to latch against the central inner ring 34 of the outer element 30.

At this point cap 1 can be tightened on the thread 43 of container 40 by rotating the outer element 30, which, in the case represented in the drawing, turns in the clockwise direction. Its projections 32 interfere against the elastic notches 13 being present on ring 15 of the inner element 10, thereby subjecting them to a stress which is contrary to their inclination direction, so that the inner element 10 follows the outer element 30 in its clockwise rotation and tightens with its thread 11 on the thread 43 of container 40. During this phase, the central push button 20 is rigidly connected with the outer element 30, since its peripheral teeth 25 engage the gills 35 of the outer element 30 and, therefore, it follows the latter in its rotation.

As can be observed in FIG. 2, the projections 32 and the gills 35 are connected through opposite parts of the inner annular surfaces 33 with the bowl 39 constituting the outer element 30.

Since the cap has been tightened, should an counterclockwise rotation be applied to the outer element 30, as has previously been said, this will not cause the untightening of cap 1 from container 40, since the projections 32 force the elastic notches 13 in the direction promoting their inclination so that the outer element 30 rotates idly around the inner element 10, which remains tight on container 40. In this case, too, the central push button 20 rigidly follows the outer element 30 during its rotation.

In order to untighten cap 1, however, it suffices to exert a vertical downward pressure on surface 27 of the central push button 20, through hole 37 on surface 38 of element 30 and, at the same time, turn the outer element 30 of cap 1 in the counterclockwise direction.

Figure 6:
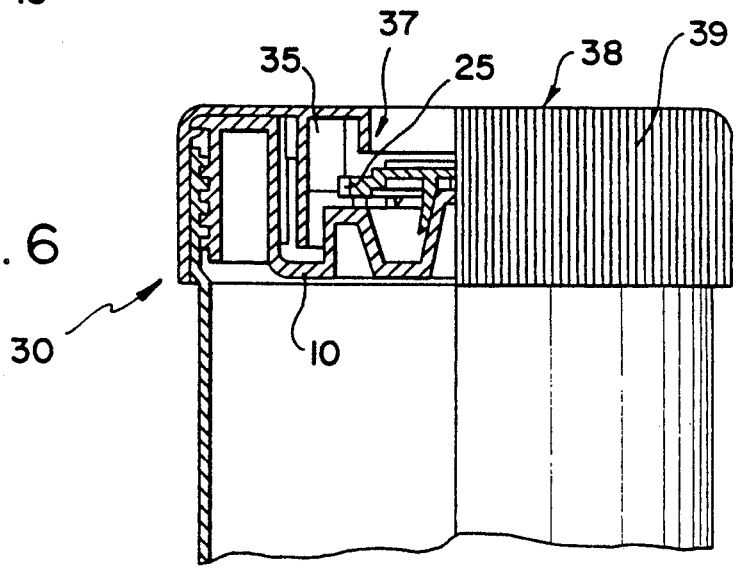
FIG. 6 is a vertical cross-section of the cap according to the invention applied to its respective container, with the central push button being engaged both with the inner element and the outer element.

By doing this, as can be observed in FIG. 6, the frontal teeth 26 of the central push button 20 couple with the teeth 18 of the inner element 10 and, since the peripheral teeth 25 of the push button 20 are constantly engaged against the gills 35 of the outer element 30, the counterclockwise direction of the latter is transmitted also to the inner element 10, which can therefore be easily untightened.

In the substance, it has been seen that, while, in order to tighten the cap, it suffices to tighten the outer element 30, thereby achieving the matching of the inner element 10 with thread 43 of the container, which will insure its shutting, in order to obtain the opening of the same container, it is necessary, on the other hand, to press the central push button 20 and, at the same time, to rotate the outer element 30 of the cap in the direction opposite to the previous one.

It can easily be understood that only the coordination of the two movements will allow the opening of the container, which is practically impossible for children or mentally handicapped persons to achieve.

It can also be understood how thread 11 on element 10, as can be observed in the FIGS. 1 and 6, reduces to a minumum the overall radial dimensions of container 40 after cap 1 has been applied.

Figure 7:
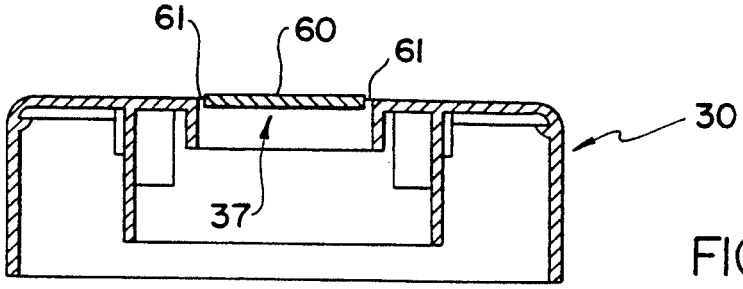
FIG. 7 is a vertical cross-section of the outer element presenting the safety seal.

The cap according to the invention can be provided with a safety seal, suited to guarantee that the container and, above all, its contents have not been tampered with before the sale. In view of this purpose it will be enough, during the manufacturing process, to have a closing disc 60 over the central hole 37, said disc having a predetermined breaking point in correspondence with the points 61 joining it to the outer element 30 itself, as can be observed in FIG. 7.

The assembly of cap 1 occurs exactly as previously described, that is by positioning the central push button 20 on the frustum-shaped projection 16 and, thereafter, pressing the outer element 30 over the inner element 10. At this point the cap can be tightened on container 40.

Since, based on what has previously been described, the untightening of cap 1 can only occur by pressing the push button 20 and by rotating, at the same time, the outer element 30, it can be understood that the breaking of disc 60 constituting the safety seal is an indispensable requisite to reopen container 40 after it has been filled and sealed by the manufacturer.

The integrity of seal 60, offers the consumer a warranty that the contents have not been tampered with after the container has been sealed.

On basis of what has been described, it can be understood how the safety cap according to the invention reaches all the proposed purposes.

First of all, the main purpose of producing a safety cap minimizing the overall dimensions of the container on which it is applied, particularly of containers having an essentially cylindrical shape, has been reached. Thus, the cap of the invention also fulfils the purpose of optimizing the usable packing volumes.

The purpose of obtaining a safety cap, suited to resist the intentional and incautious opening particularly on the part of children or mentally handicapped people, has also been reached.

It has also been seen how easily the cap can be provided with a seal, suited to offer to the final consumer a warranty of the integrity of the package and, therefore, of the contents of the container.

Obviously during the manufacturing process, the cap of the invention may undergo several variations concerning, for instance, the number of teeth and projections, or the number of gills or the shape of the surfaces of the outer element 30 and the tightening thread, without exceeding, however, the scope of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A safety cap for a container having an essentially cylindrical shape, said cap comprising:

an inner element having a thread and two concentric rings connected together through a flat ring, the outer ring has a thread while the inner ring has elastic notches and a closed button with a central frustum shaped indentation and another toroid indentation concentric therewith, the toroid indentation having a flat annular surface with frontal teeth thereon;

an outer element placed over the inner element, said outer element having a generally flat surface with a through hole defined therein;

means provided on the inner element and outer element for rigidly connecting the inner and outer element when the cap is turned in a tightening direction;

a central push button positioned between the inner element and the outer element, said central push button being lodged within the through hole of the outer element; and means provided on the central push button, the inner element and the outer element for rigidly connected the inner and outer element when the cap is turned in an untightening direction and when axial pressure is applied to the central push button.

2. The safety cap according to claim 1, characterized in that the outer element comprises a bowl having a circular cross section having the generally flat surface with the through hole, and an annular surface coaxial with the bowl, said annular surface having interfering projections and gills positioned within the bowl.

3. The safety cap according to claim 1, characterized in that the central push button has an essentially circular shape and has a central cylindrical seat and a plurality of teeth arranged along a periphery surface thereof and around a flat surface adjacent the periphery surface.

4. The safety cap according to claim 1, characterized by the outer element and the inner element being coaxial and connected with each other through a circular edge on the external circumference of the a flat annular ring of the inner element which is lodged in an annular indentation in the outer element.

5. The safety cap according to claims 1, 3 or 4 characterized in that a central seat of the central push button matches the frustum shaped central indentation of the inner element.

6. The safety cap according to claim 5, characterized in that the matching between the central cylindrical seat of the central push button and the frustum shaped central indentation of the inner element is made elastic by extensions and vertical slits on lateral walls of the central cylindrical seat of the central push button.

7. The safety cap according to claim 1, characterized in that the means for rigidly connecting the outer element and the inner element when the cap is turned in the tightening direction comprises vertical projections of the outer element engaging with the elastic notches of the inner element.

8. The safety cap according to claim 1, characterized in that the means for rigidly connecting the outer element and the inner element when the cap is turned in the untightening direction comprises vertical gills of the outer element engaging with peripheral teeth of the central push buttom and comprises a plurality of frontal teeth of the central push button engaging with an equal number of the frontal teeth of the inner element.

9. The safety cap according to claim 1, characterized in that the central push button has an annular pressing surface which can be reached through the through hole in the generally flat surface of the outer element.

10. The safety cap according to claim 1, characterized in that a safety seal comprising a disc is lodged in the through hole of the outer element, said disc being connected with the outer element by extensions which will break under pressure.

* * * * *